US007056146B2

(12) United States Patent
Hiramoto et al.

(10) Patent No.: US 7,056,146 B2
(45) Date of Patent: Jun. 6, 2006

(54) INSULATION DISPLACEMENT CONTACT AND ELECTRIC CONNECTOR USING THE SAME

(75) Inventors: Masayuki Hiramoto, Osaka (JP); Takashi Suyama, Osaka (JP); Terumi Nakashima, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/097,135

(22) Filed: Apr. 4, 2005

(65) Prior Publication Data

US 2005/0221658 A1 Oct. 6, 2005

(30) Foreign Application Priority Data

Apr. 5, 2004 (JP) ..... 2004-111466

(51) Int. Cl.
*H01R 14/24* (2006.01)

(52) U.S. Cl. ..... 439/397

(58) Field of Classification Search ..... 439/397, 439/398, 399, 404
See application file for complete search history.

(56) References Cited

U.S. PATENT DOCUMENTS

| | | | | |
|---|---|---|---|---|
| 4,820,179 | A * | 4/1989 | Saijo | 439/397 |
| 5,683,267 | A * | 11/1997 | Ribbeck et al. | 439/397 |
| D464,322 | S * | 10/2002 | Hiramoto et al. | D13/154 |

FOREIGN PATENT DOCUMENTS

| | | | |
|---|---|---|---|
| JP | 59-42785 | A | 3/1984 |
| JP | 60-68568 | A | 4/1985 |
| JP | 61-75071 | U | 5/1986 |
| JP | 61-116773 | A | 6/1986 |
| JP | 61-224277 | | 10/1986 |
| JP | 6-21184 | | 6/1994 |
| JP | 08-273710 | A | 10/1996 |
| JP | 10-116658 | A | 5/1998 |
| JP | 10-199602 | A | 7/1998 |

* cited by examiner

*Primary Examiner*—Briggitte R. Hammond
(74) *Attorney, Agent, or Firm*—Rader, Fishman & Grauer PLLC

(57) ABSTRACT

An insulation displacement contact includes a pair of insulation displacement blades and a pair of resilient contact pieces. The pair of insulation displacement blades are opposite to each other with their bases connected to each other such that there is formed, by their inner sides, a slot for receiving an insulated wire of which core wire portion is covered with an insulation. The pair of insulation displacement blades are arranged such that when the insulated wire is inserted into the slot, the insulation is cut and the core wire portion comes in press-contact with the insulation displacement blades. Each of the pair of resilient contact pieces is made of a plate member which is connected to the outer side of each insulation displacement blade, which extends toward the side opposite of the inlet of the slot up to a position exceeding the base of each insulation displacement blade, which has a contact portion for holding or nipping a mating contact at a position opposite of the slot inlet with respect to the base of each insulation displacement blade, and which has, between the connection portion connected to the outer side of each insulation displacement blade and the contact portion, a tapering portion of which width is gradually narrowed in the direction toward the contact portion.

10 Claims, 7 Drawing Sheets

INSULATION DISPLACEMENT CONTACT AND ELECTRIC CONNECTOR USING THE SAME

BACKGROUND OF THE INVENTION

1. Field of the Invention

The present invention relates to an insulation displacement contact and an electric connector (insulation displacement connector) using the same.

2. Description of Related Art

A connector to be attached to an insulated wire has a resin housing and a contact (terminal metal fitting) secured to the housing. An insulation displacement contact has the structure in which a slot for holding the core wire portion of an insulated wire is formed between a pair of insulation displacement blades for breaking up the insulation of the insulated wire. When such an insulation displacement contact is used, the contact and the core wire portion of the insulated wire can be electrically connected to each other merely by pushing the insulated wire into the slot of the insulation displacement contact. A connector using such an insulation displacement contact is called an insulation displacement connector.

For example, as disclosed in Japanese Unexamined Patent Publication (KOKAI) No. 59-42785 (1984), the insulation displacement contact has the arrangement in which a pair of insulation displacement blades forming a slot as mentioned above are connected at their bases to each other and that the insulation displacement blades are provided at the outer sides thereof with a pair of contact pieces for connection with the contact of a base connector (board-side connector). Each of this pair of contact pieces is made of a uniform-width plate-like body which extends beyond the base of each insulation displacement blade up to the side opposite to the inlet of the slot. Each plate-like body is provided at the tip thereof with a contact portion for nipping the contact of the base connector.

In the insulation displacement connector disclosed in the above-mentioned Publication, the tips of the pair of contact pieces are inwardly bent such that the contact of the base connector is held between and by the tips thus bent.

A connector used in a recent small-size device including, as a typical example, a digital still camera, a video camera, a cellular phone, a PDA (personal digital assistant) or the like, is extremely miniaturized in size, and is a multi-pole connector having a number of poles. Accordingly, the insulation displacement connector is inevitably extremely miniaturized in size; therefore, has no spatial room for providing bent portions at the tips of the contact pieces as the insulation displacement contact disclosed in the above-mentioned Publication.

On the other hand, when an insulated wire is inserted into the slot between the pair of insulation displacement blades, the slot is resiliently deformed and expanded. At this time, the pair of insulation displacement blades are rotated around their bases. Consequently, the pair of contact pieces connected to the outer sides of the pair of insulation displacement blades are also rotated to narrow the gap between the pair of contact portions. In the case of an insulation displacement connector extremely miniaturized in size, the gap between the pair of contact portions is often eliminated to cause the contact portions to come in contact with each other.

Under such circumstances, when the contact of a base connector is inserted between the pair of contact portions, the gap between these contact portions is press opened and expanded. At this time, when the contact pieces are provided at the tips thereof with bent portions as done in the above-mentioned Publication, the bent portions and the entire contact pieces are resiliently deformed, causing the base connector contact to be resiliently held or nipped by and between the contact portions.

However, for an extremely miniaturized insulation displacement contact in which the contact pieces cannot be provided at their tips with bent portions, the insertion of the base connector contact has to rely solely on the resilient deformation of the contact pieces in their entirety. However, when each of the contact pieces is made of a uniform-width plate-like body, stress is concentrated on the base of the contact piece. More specifically, as a matter of fact, the resilient deformation of the bases of the contact pieces produces, between the pair of contact portions, a gap for receiving the base connector contact.

On the other hand, in a multi-pole connector extremely miniaturized in size, the contact pieces are also extremely miniaturized in size. Accordingly, when the base connector contact is inserted between the contact portions, the amount of expansion and deformation of the contact pieces readily exceeds a resilient deformation range and enters a plastic deformation range. Under such circumferences, the contact pieces loose almost all of its restoring force. It is therefore not possible that the contact portions come in resilient contact with the base connector contact. This may possibly injure the reliability of electric connection therebetween.

For example, when the contact pieces are not connected to the outer sides of the pair of insulation displacement blades, but are connected to the bases thereof, the above-mentioned problem is somewhat relaxed. In such a case, however, the entire height of the insulation displacement contact is equal to the sum of the height of the insulation displacement blades and the height of the contact pieces. This results in increase in the entire height of the insulation displacement connector. This goes against the market demand for an electric connector to be used in a small-size electronic device.

SUMMARY OF THE INVENTION

It is an object of the present invention to provide an insulation displacement contact, even extremely miniaturized in size, capable of assuring a resilient contact with a counterpart contact, and also to provide an electric connector using this insulation displacement contact.

An insulation displacement contact according to the present invention comprises: a pair of insulation displacement blades opposite to each other with their bases connected to each other such that there is formed, by their inner sides, a slot for receiving an insulated wire of which core wire portion is covered with an insulation, the pair of insulation displacement blades being arranged such that when the insulated wire is inserted into the slot, the insulation is cut and the core wire portion comes in press-contact with the insulation displacement blades; and a pair of resilient contact pieces each made of a plate member which is connected to the outer side of each insulation displacement blade, which extends, toward the side opposite the inlet of the slot, up to a position exceeding the base of each insulation displacement blade, which has a contact portion for holding or nipping a mating contact at a position opposite the slot inlet with respect to the base of each insulation displacement blade, and which has, between the connection portion connected to the outer side of each insulation displacement blade and the contact portion, a tapering portion of which width is gradually narrowed in the direction toward the contact portion.

An electric connector according to the present invention comprises: an insulation displacement contact having the above-mentioned characteristics; and a housing made of resin which holds the insulation displacement contact in a contact holding portion.

Preferably, the insulation displacement contact is formed by punching or bending a single conductive metallic plate.

Each tapering portion may be formed in the entire range from the contact-portion-side end of the connection portion connecting the resilient contact piece to the outer side of the insulation displacement blade, up to the contact portion.

Each tapering portion may have a curved side concaved inwardly of the width of the plate member.

Two pairs of the insulation displacement blades may be disposed as facing each other with the slots aligned in a predetermined direction, and these two pairs of insulation displacement blades may be connected at their bases to each other by a connecting plate.

In the above-mentioned arrangement, the resilient contact pieces may be connected to the outer sides of one of two pairs of the insulation displacement blades, and may be formed as extending in the direction away from the other pair of the insulation displacement blades. In this case, it is advantageous that the two pairs of insulation displacement blades are respectively connected to the both ends of the connecting plate, and that the connecting plate is provided at the lateral sides thereof with retaining projections arranged to be engaged with the inner walls of the housing.

The resilient contact pieces maybe connected to the outer sides of one of the two pairs of the insulation displacement blades, and may be formed as extending in the direction toward the other pair of the insulation displacement blades. In this case, it is advantageous that the retaining projections to be engaged with the inner walls of the housing are disposed at those end edges of the resilient contact pieces which are opposite the contact portions thereof.

According to the present invention, each of the pair of resilient contact pieces has a tapering portion of which width is gradually narrowed in the direction toward the contact portion. Accordingly, when a counterpart contact is held or nipped by and between the pair of contact portions, the stress is dispersed at the tapering portions. Accordingly, as compared with the arrangement in which each of the resilient contact pieces is made of a uniform-width plate-like body, the stress concentration can be restrained, and the entire tapering portions are therefore resiliently deformed as bent, thus increasing the resilient deformation range of the resilient contact pieces in their entirety.

Accordingly, even though a counterpart contact is inserted between the contact portions in the state where an insulated wire is inserted (press-fitted) into the slot formed by the pair of insulation displacement blades to rotate the resilient contact pieces to narrow (or eliminate) the gap between the contact portions, the amount of deformation of the resilient contact pieces is restrained or prevented from exceeding the resilient deformation range and then entering the plastic deformation range. Accordingly, even though the insulation displacement contact is extremely miniaturized in size, it is possible to assure the state where the contact portions come in resilient contact with the counterpart contact, thus improving the reliability of the electric connection.

Further, the resilient contact pieces are formed as connected to the outer sides of the insulation displacement blades. This prevents the entire height of the insulation displacement contact from being high. This consequently prevents the entire height of the electric connector from being high.

Thus, there can be achieved an electric connector extremely miniaturized in size and low in height, yet capable of assuring a high reliability of electric connection.

The foregoing and other elements, features, steps, characteristics and advantages of the present invention will become more apparent from the following detailed description of the preferred embodiments with reference to the attached drawings.

DESCRIPTION OF THE PREFERRED EMBODIMENTS

Figure 1:
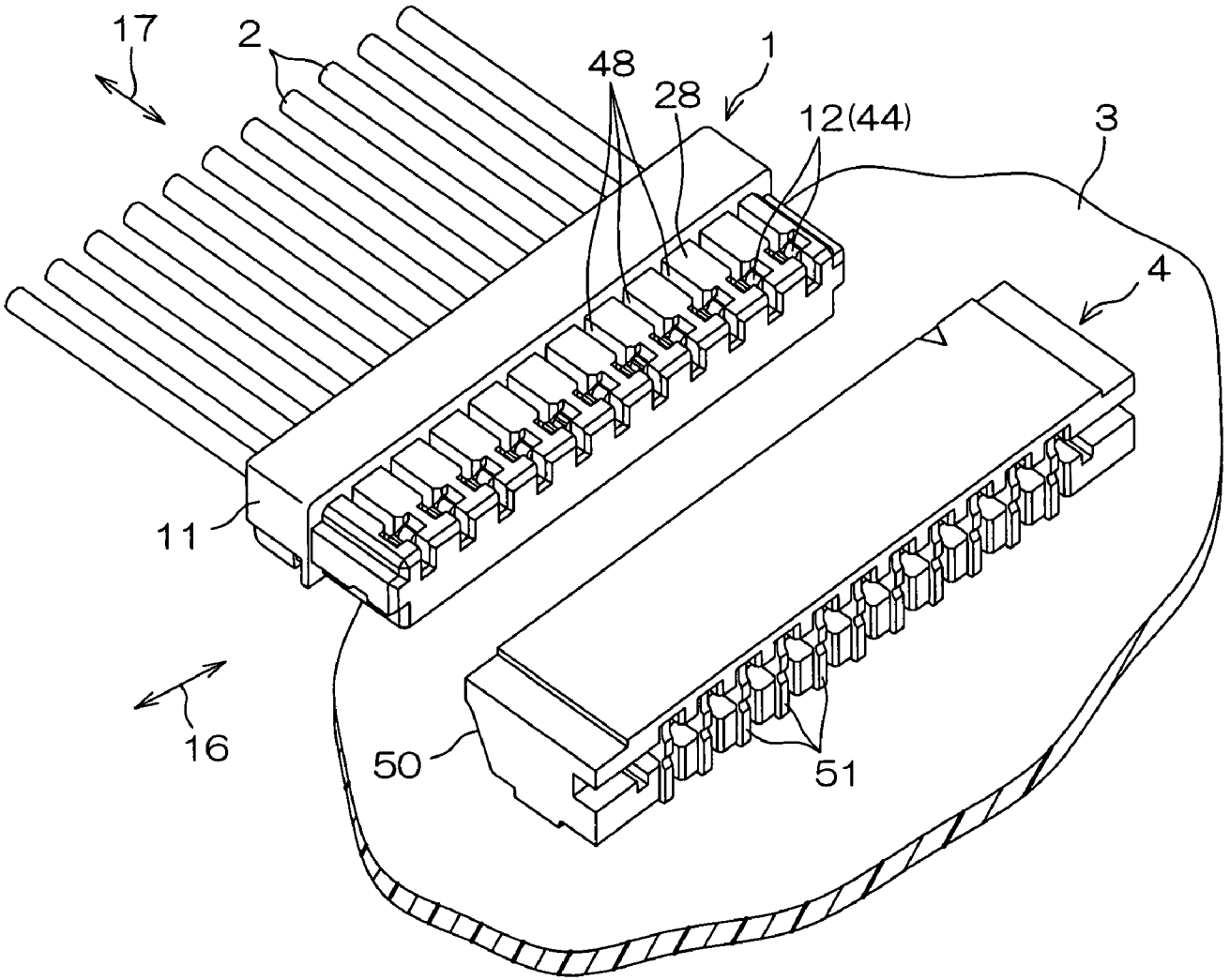
FIG. 1 is a perspective view illustrating how to use an electric connector according to a preferred embodiment of the present invention.

FIG. 1 is a perspective view illustrating how to use an electric connector according to a preferred embodiment of the present invention. The electric connector 1 according to this embodiment is a wire-side connector connected to a plurality of insulated wires 2. This wire-side connector 1 can be connected, for example, to a board-side connector (base connector) 4 surface-mounted on a printed circuit board 3. When the wire-side connector 1 is connected to the board-side connector 4, the insulated wires 2 are electrically connected to the printed circuit board 3.

Figure 2:
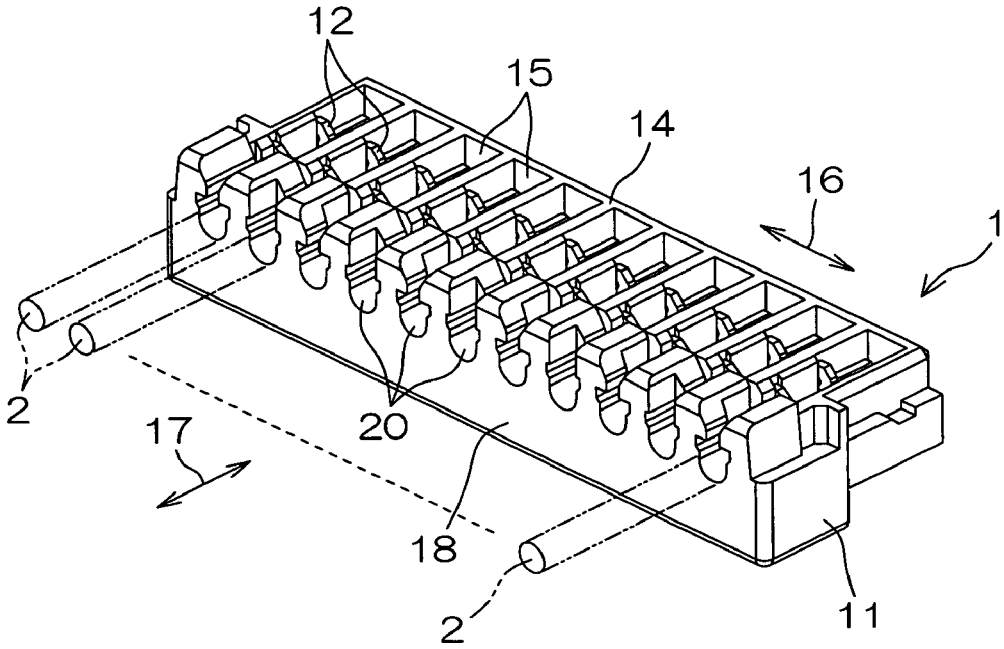
FIG. 2 is a perspective view of the wire-side connector with its actual upside turned down, when viewed from the rear side to which insulated wires are to be connected.
Figure 3:
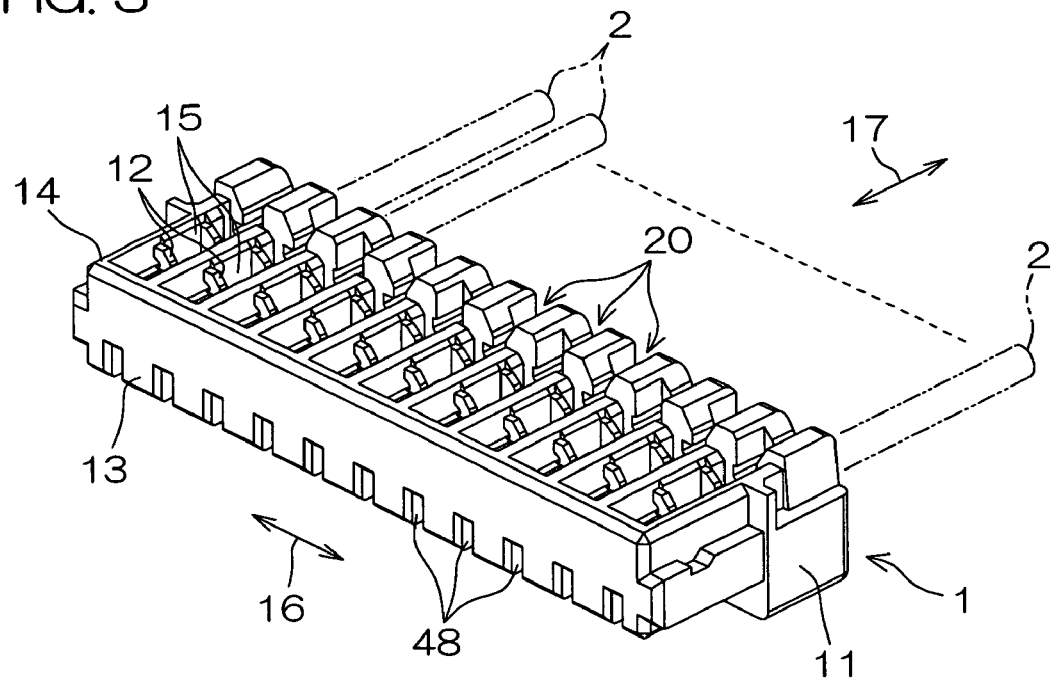
FIG. 3 is a perspective view of the wire-side connector with its actual upside turned down, when viewed from the front side (from the board-side connector)

FIG. 2 and FIG. 3 are perspective views of the wire-side connector 1 with its actual upside turned down. FIG. 2 shows the wire-side connector 1 as viewed from the rear side to which the insulated wires 2 are to be connected, while FIG. 3 shows the wire-side connector 1 as viewed from the front side (from the board-side connector 4).

This wire-side connector 1 comprises a housing 11 made of a synthetic resin molded article, and insulation displacement contacts (terminal metal fittings) 12 press-fitted into and held by the housing 11. This housing 11 is formed substantially in a rectangular parallelepiped box. The housing 11 is provided at the front face 13 side thereof with a plurality of groove-shape contact holding portions 15 which are opened in the bottom (the side opposite to the printed circuit board 3 when actually used) and which are arranged along the widthwise direction 16 of the housing 11. The contact holding portions 15 are formed along the axial direction 17 of the insulated wires 2 at right angles to the widthwise direction 16. The contact holding portions are arranged to hold the insulation displacement contacts which can be press-fitted into the contact holding portions from the bottom face 14 side of the housing 11.

At positions nearer to the rear face 18 of the housing rather than to the contact holding portions 15, a plurality of wire holding portions 20 respectively corresponding to the contact holding portions 15 are formed along the widthwise direction 16.

Figure 4:
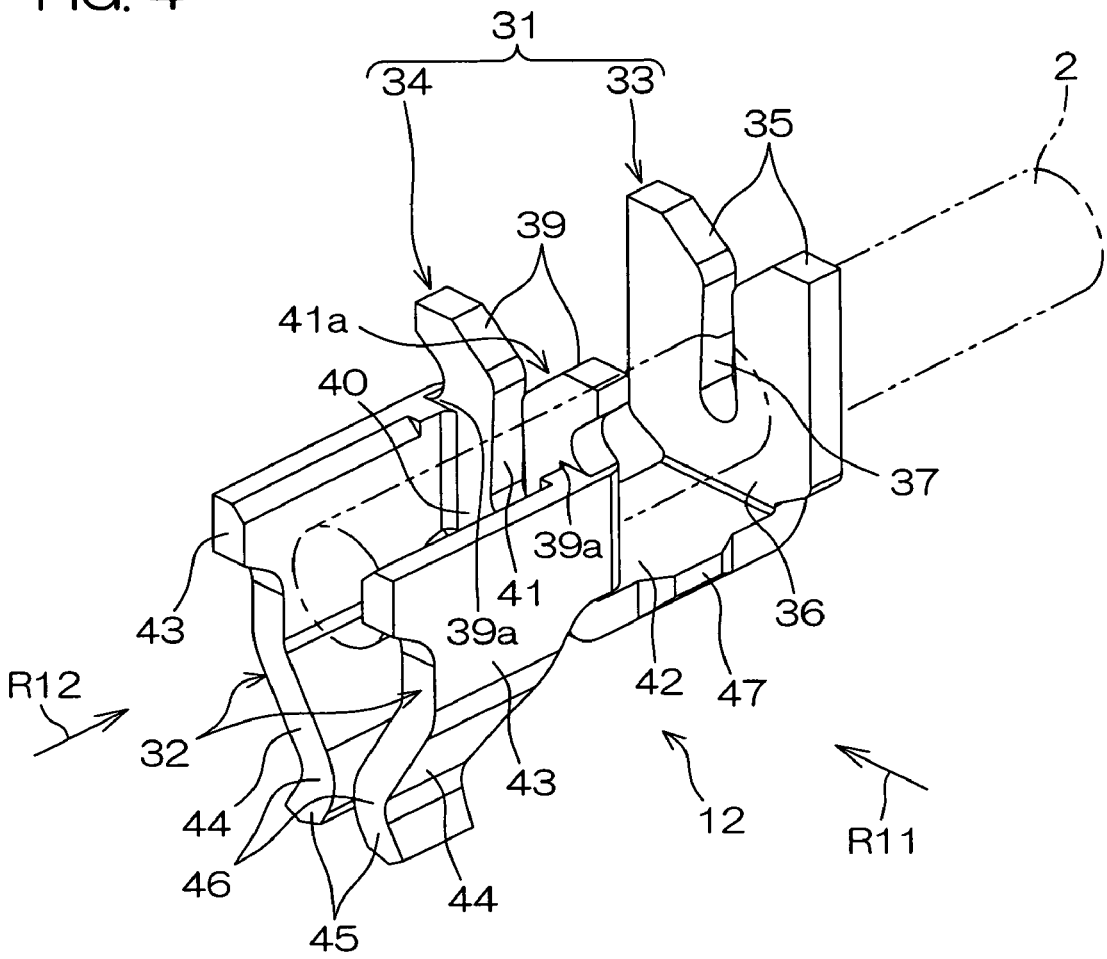
FIG. 4 is a perspective view of an insulation displacement contact of the wire-side connector.
Figure 5:
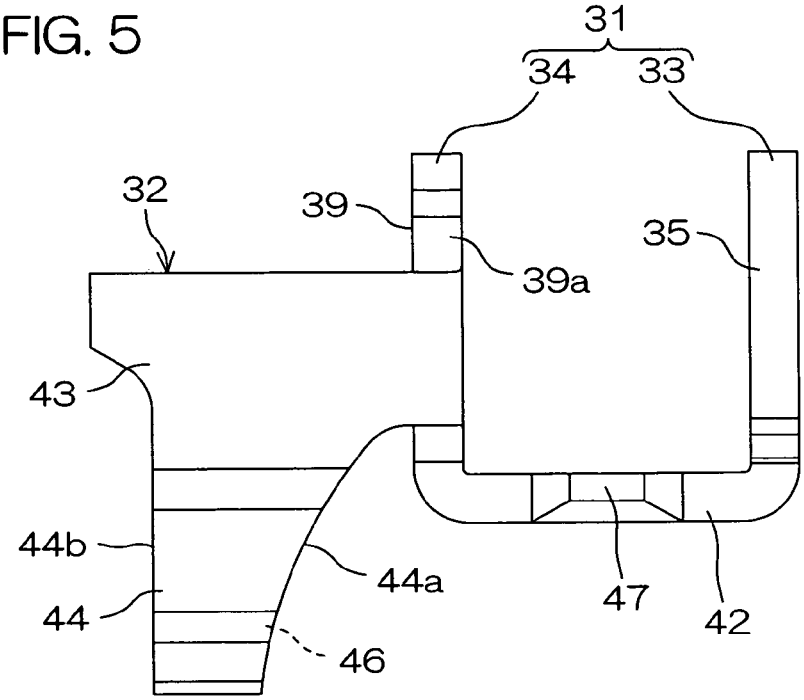
FIG. 5 is a side view of the insulation displacement contact, illustrating its arrangement when viewed in the arrow R11 in FIG. 4.
Figure 6:
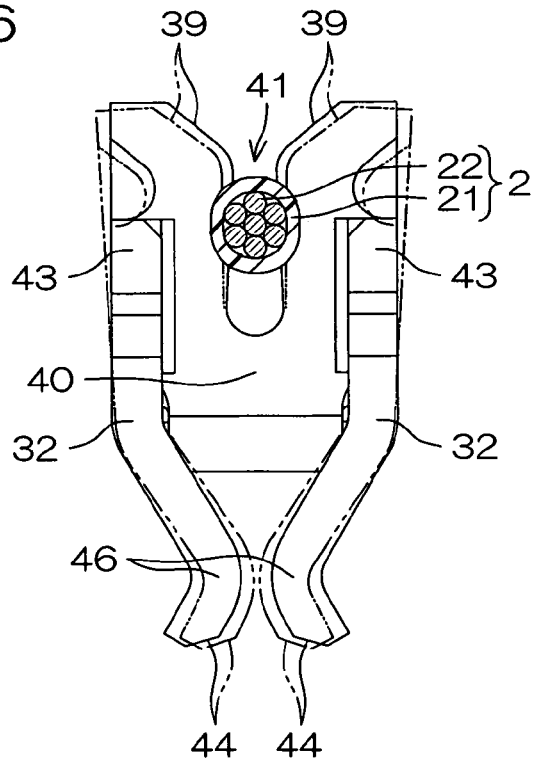
FIG. 6 is a front view of the insulation displacement contact, illustrating its arrangement when viewed in the arrow R12 in FIG. 4.

FIG. 4 is a perspective view of the insulation displacement contact 12, and FIG. 5 is a side view of the insulation displacement contact 12, illustrating its arrangement when viewed in the arrow R11 in FIG. 4. FIG. 6 is a front view of the insulation displacement contact 12, illustrating its arrangement when viewed in the arrow R12 in FIG. 4.

The insulation displacement contact 12 is formed in a unitary structure by punching or bending a single conductive metallic thin plate (for example, a plated copperplate). The insulation displacement contact 12 is provided, at its rear portion corresponding to the housing rear face 18 side, with an insulation displacement part 31 to which an insulated wire 2 is coupled. Also, the insulation displacement contact 12 is provided, at its front portion, with a pair of resilient contact pieces 32 which come in contact with a contact 51 (See FIG. 1) of the board-side connector 4.

The insulation displacement part 31 has a first insulation displacement portion 33 and a second insulation displacement portion 34 separated from each other back and force. The first insulation displacement portion 33 has a pair of insulation displacement blades 35 and a connection portion 36 which connect the bases (the root portions) of the insulation displacement blades 35 to each other for holding the insulation displacement blades 35 such that they face each other. The pair of insulation displacement blades 35 define, by their inner sides, a slot 37 in which the core wire portion of an insulated wire 2 is press-fitted and held. Likewise, the second insulation displacement portion 34 has a pair of insulation displacement blades 39 defining a slot 41, and the pair of insulation displacement blades 39 are connected to each other at their bases (root portions) by a connection portion 40. The connection portions 36, 40 are connected to each other by a bottom plate 42 (connecting plate). More specifically, the first and second insulation displacement portions 33, 34 are connected to the end sides of the bottom plate 42. The bottom plate 42 is provided at each lateral side thereof with a laterally projecting press-fitting projection 47. The press-fitting projections 47 are arranged such that when the insulation displacement contact 12 is pressed into the corresponding contact holding portion 15 of the housing 11, the press-fitting projections 47 bite into the inner walls of the contact holding portion 15 such that the insulation displacement contact 12 is held by the contact holding portion 15.

The resilient contact pieces 32 have (i) a pair of lateral plates (portions connected to the outer sides 39*a* of the pair of insulation displacement blades 39) 43 forwardly extending in parallel to each other from the outer sides 39*a* of the insulation displacement blades 39 of the second insulation displacement portion 34, and (ii) a pair of resilient nipping portions 44 extending from the lateral plates 43 in the vertical direction at right angles to the axial direction of the insulated wire 2. The pair of resilient nipping portions 44 extend from the lateral plates 43 in the direction opposite an inlet 41*a* of the slot 41 formed by the pair of insulation displacement blades 39 and in the direction substantially parallel to the insulation displacement blades 39 (in the vertical direction at right angles to the axial direction of the insulated wires 2). More specifically, the pair of resilient nipping portions 44 extend from the pair of lateral plates 43 in a slightly inwardly inclined manner so as to get nearer to each other, and are provided at the tips thereof with guiding inclined portions 45 which are inclined in expanding and opening directions after having passed through the mutual closest portions of the resilient nipping portions 44. The mutual closest portions of the pair of resilient nipping portions 44 serve as contact portions 46 arranged to resiliently hold or nip the corresponding contact 51 of the board-side connector 4 (See FIG. 1). More specifically, these resilient nipping portions 44 are formed as extending up to positions opposite the inlet 41*a* of the slot 41 with respect to the connection portion 40 or the bases of the pair of insulation displacement blades 39, and the contact portions 46 are located in positions opposite the inlet 41*a* of the slot 41 with respect to the connection portion 40.

As shown in FIG. 1, the housing 11 is provided in the top face 28 thereof with contact receiving grooves 48 for receiving the contacts 51 of the board-side connector 4, the grooves 48 being formed in the axial direction 17 of the insulated wires 2. Provision is made such that the resilient nipping portions 44 of the insulation displacement contacts 12 are inserted into the contact receiving grooves 48.

As best shown in FIG. 5, each resilient nipping portion 44 forms a tapering portion made of a tapering plate-like body of which width is gradually narrowed, in the entire range from the lateral plate 43 to the contact portion 46, in the direction toward the contact portion 46. Further, in this preferred embodiment, the resilient nipping portion 44 has, at the side of the insulation displacement blades 39, a lateral side 44*a* in a curved form concaved inwardly of the plate widthwise direction, and also has, at the other side, a lateral side 44*b* linearly extending along the standing direction of the insulation displacement blades 39.

When the corresponding contact 51 of the board-side connector 4 is inserted between the pair of contact portions 46, the resilient nipping portions 44 in such a tapering form are resiliently deformed as if they bend in their entirety, thus preventing the stress from being locally concentrated. Therefore, the resilient deformation range is high, thus restraining or preventing the resilient nipping portions 44 from being subjected to plastic deformation due to the insertion of the contacts 51 of the board-side connector 4.

When an insulated wire 2 is press-fitted into the slot 41, an insulation 21 of the insulated wire 2 is broken up by the inner sides of the pair of insulation displacement blades 39, and the inner sides of the pair of insulation displacement blades 39 come in press-contact with the core wires 22 of the insulated wire 2. At this time, as shown by the chain double-dashed lines in FIG. 6, the pair of insulation displacement blades 39 are rotated in expanding and opening directions around their bases or connection portion 40. This causes the insulation displacement blades 39 to be resiliently deformed such that the core wires 22 of the insulated wire 2 are held or nipped by and between the insulation displacement blades 39 due to their restoring force.

On the other hand, when the pair of insulation displacement blades 39 are deformed in expanding and opening directions, the pair of resilient nipping portions 44 of the pair of resilient contact pieces 32 connected to the outer sides 39*a* of the insulation displacement blades 39, are rotated around the vicinity of the connection portion 40 in directions in which their contact portions 46 get closer to each other. This narrows or eliminates the gap between the contact portions 46.

Under such circumferences, when the electric connector 1 is mounted on the board-side connector 4, the contacts 51 of the board-side connector 4 press expand the gap between the pairs of contact portions 46 and then enter the gap, thus causing the contacts 51 to be held or nipped by and between the contact portions 46. At this time, the pairs of resilient nipping portions 44 are resiliently deformed so that they bend in their entirety, and hold or nip the contacts 51 due to their restoring force. The pairs of resilient nipping portions 44 are so formed as to prevent the stress from being concentrated to increase the resilient deformation range. Accordingly, there is no possibility of the resilient nipping portions 44 being plastically deformed by the insertion of the contacts 51. Therefore, the electric connection between the contacts 51 and the contact portions 46 can be successfully maintained.

Figure 7A:
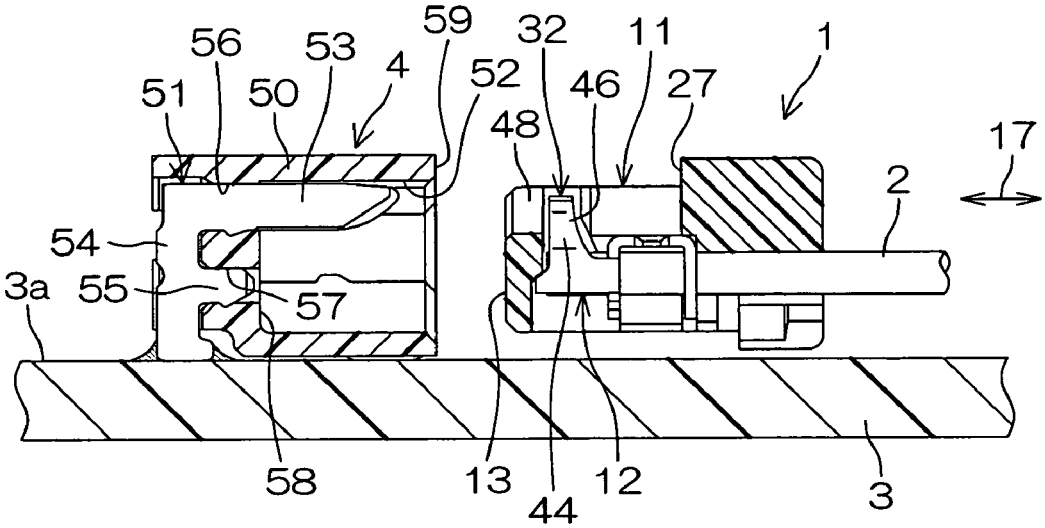
FIG. 7(*a*) is a section view illustrating the wire-side connector and the board-side connector before fitting to each other, and FIG. 7(*b*) is a section view illustrating the wire-side connector and the board-side connector fitted to each other.
Figure 7B:
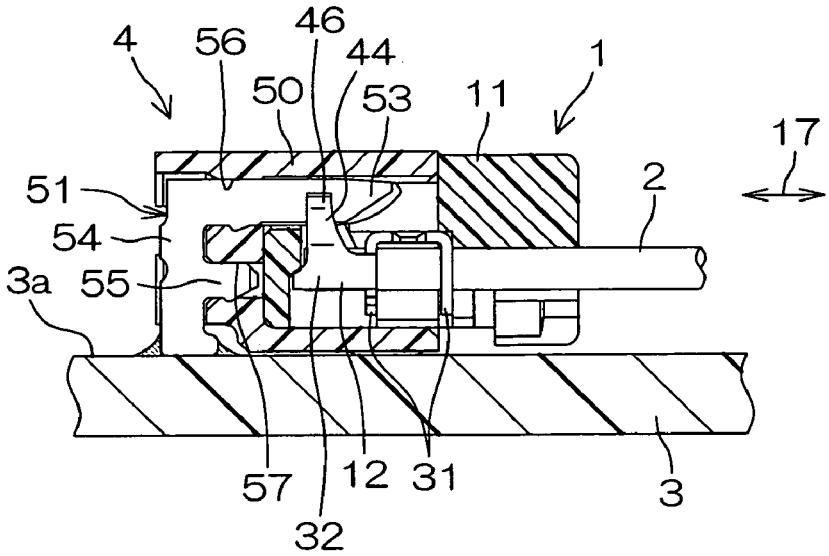

FIG. 7(*a*) is a section view illustrating the wire-side connector 1 and the board-side connector 4 before fitting to each other, and FIG. 7(*b*) is a section view illustrating the wire-side connector 1 and the board-side connector 4 fitted to each other. The board-side connector 4 has a housing 50 made of a resin molded article, and a plurality of contacts 51 pressed into and held by the housing 50. The housing 50 has a fitting hole 52 opened in the front side opposite to the wire-side connector 1, and the front portion of the housing 11 of the wire-side connector 1 is to be fitted into this fitting hole 52.

The plurality of contacts 51 are pressed into the housing 50 from the rear side thereof, and held by the housing 50 such that they are disposed side by side in the direction parallel to the insertion direction of the wire-side connector 1. Each contact 51 has (i) a contact portion 53 projecting into the fitting hole 52, (ii) a joint portion 54 which downwardly extends from the rear end of the contact portion 53 toward the mounting face 3*a* of the printed circuit board 3 and which is soldered to the surface of the printed circuit board 3, and (iii) a press-fitting piece 55 which projects forwardly from an intermediate portion of the joint portion 54 and which is pressed into a press-fitting hole 57 in the housing 50. Each contact 51 is pressed into and fixed to the housing 50 when the contact portion 53 is pressed into a terminal insertion hole 56 and the press-fitting piece 55 is pressed into the press-fitting hole 57.

When the wire-side connector 1 is inserted into the board-side connector 4, the front face 13 of the housing 11 of the wire-side connector 1 comes in contact with the inner bottom face 58 of the fitting hole 52 of the board-side connector 4, or a step portion 27 of the housing 11 comes in contact with an opening edge 59 of the housing 50 of the board-side connector 4. This regulates the relative positions, in the axial direction 17 of the insulated wires 2, of the wire-side connector 1 and the board-side connector 4. When the front portion of the housing 11 of the wire-side connector 1 is fitted into the fitting hole 52 of the board-side connector 4, the contact portions 53 of the contacts 51 of the board-side connector 4 are introduced, as accurately positioned, into the contact receiving grooves 48 of the wire-side connector 1. Thus, the contact portions 53 are resiliently held in the contact receiving grooves 48 by the pairs of contact portions 46 of the insulation displacement contacts 12. This achieves the electric connection between the contacts 12 and 51, causing the insulated wires 2 to be electrically connected to the printed circuit board 3.

As discussed in the foregoing, the preferred embodiment mentioned above is arranged such that the resilient nipping portions 44 of the resilient contact pieces 32 of the insulation displacement contacts 12 are made of a tapering plate-like body of which width is gradually narrowed in the direction toward the contact portions 46, thus preventing the stress from being concentrated to increase the resilient deformation range. Accordingly, even though the insulation displacement blades 35, 39 forming the slots 37, 41, are deformed in expanding and opening directions by the insertion of the insulated wires 2 into the slots 37, 41, and the pairs of resilient nipping portions 44 are consequently rotated such that the gaps between the contact portions 46 are narrowed, the amount of deformation of the resilient nipping portions 44 does not reaches the plastic deformation range when the contacts 51 are inserted between the pairs of contact portions 46. This achieves a highly reliable electric connection.

Further, each resilient nipping portion 44 has a structure capable of assuring a high resilient deformation range even though it is a simple plate-like body having no bent portion or the like. Accordingly, even though the electric connector 1 is extremely miniaturized in size and each insulation displacement contact 12 is made in minute size, the insulation displacement contact 12 is capable of assuring a sufficient resilient deformation range. This remarkably improves the reliability of electric connection of the connector in extremely minute size.

Further, the resilient contact pieces 32 are formed by (i) the lateral plates 43 serving as connection portions connected to the outer sides 39*a* of the insulation displacement blades 39, and (ii) the resilient nipping portions 44 connected to the pair of lateral plates 43. Accordingly, the height of each insulation displacement contact 12 is smaller than the sum of the height of the insulation displacement blades 39 and the height of the resilient contact pieces 32. Therefore, the electric connector 1 can be reduced in height, thus achieving a small-height connector suitably used inside of a small-size electronic device.

Thus, the above-mentioned preferred embodiment achieves improvement in the reliability of electric connection of a small-sized and short-height connector.

Figure 8:
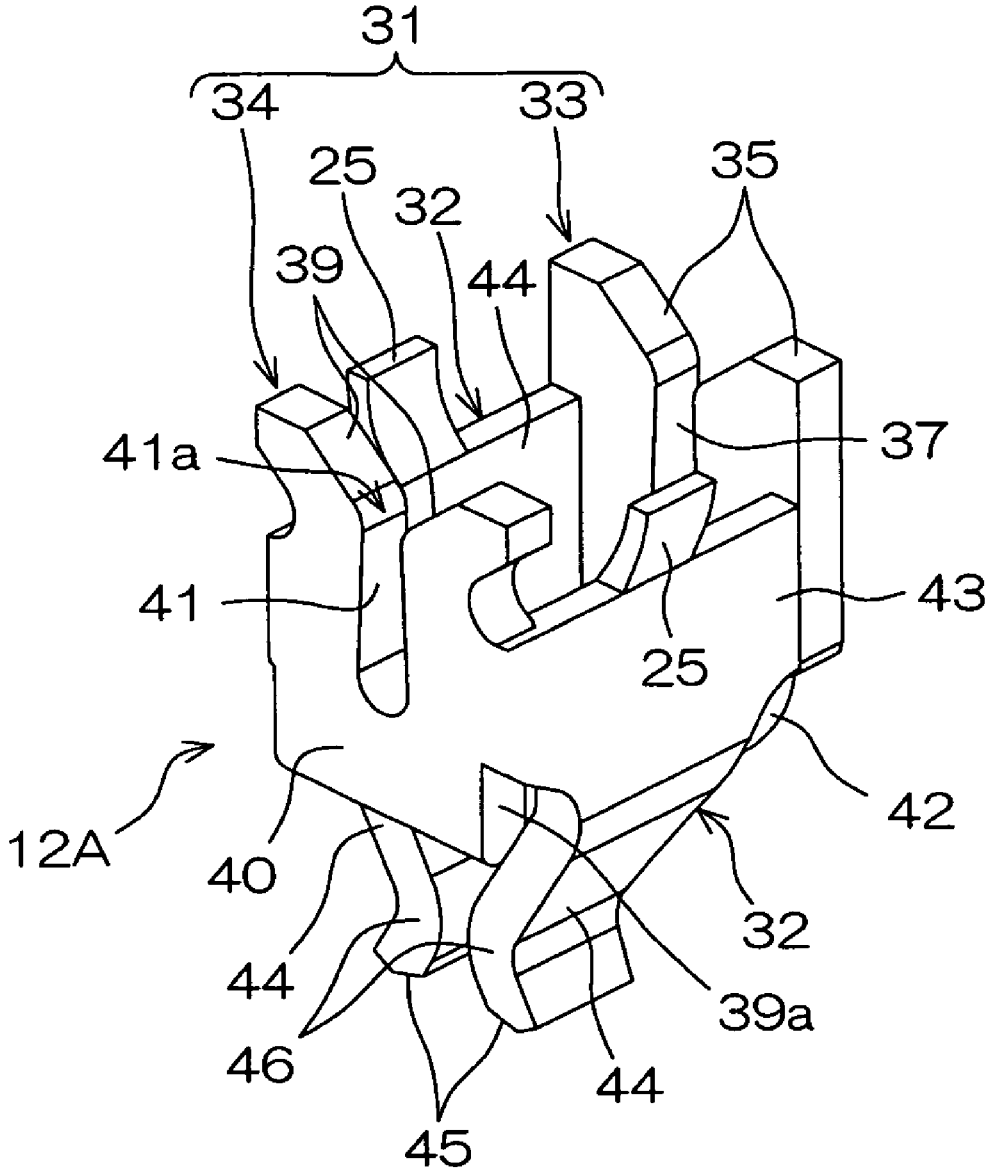
FIG. 8 is a perspective view of an insulation displacement contact according to another preferred embodiment of the present invention.
Figure 9A:
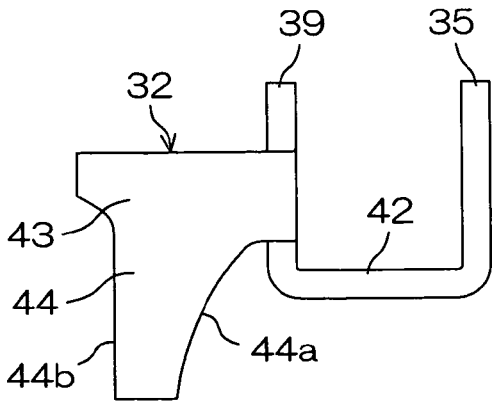
FIG. 9(*a*) to FIG. 9(*e*) are schematic side views of modifications of a resilient nipping portion.
Figure 9B:
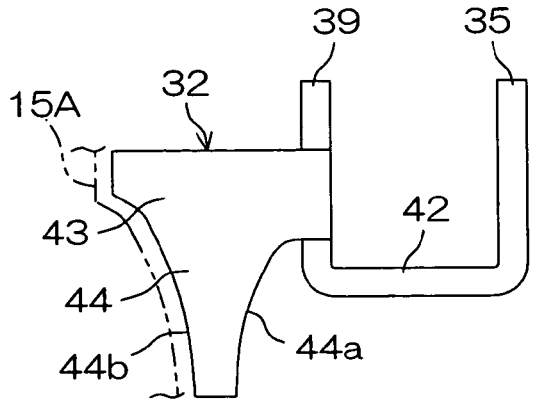
Figure 9C:
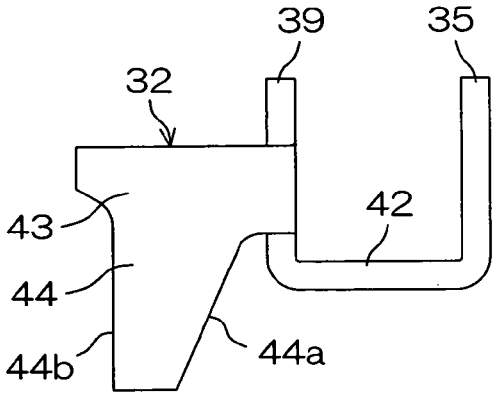
Figure 9D:
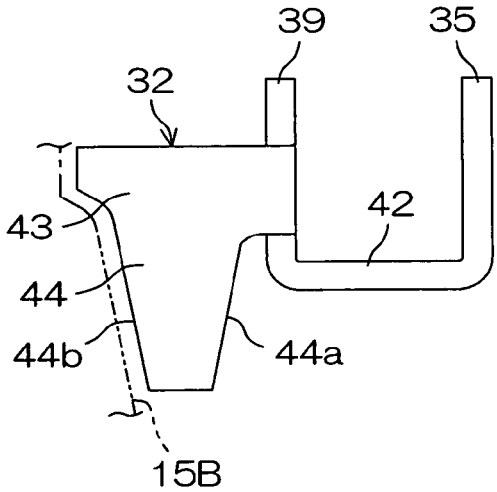
Figure 9E:
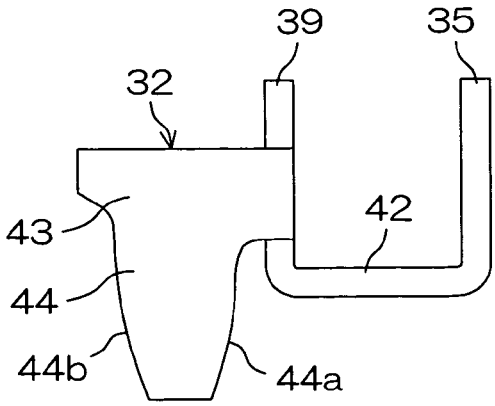

FIG. 8 is a view illustrating another preferred embodiment of the present invention. That is, FIG. 8 is a perspective view of an insulation displacement contact 12A to be used instead of the insulation displacement contact 12 mentioned above. In FIG. 8, the respective parts corresponding to those shown in FIG. 4 are designated by the reference numerals used therein.

In the insulation displacement contact 12A, a pair of lateral plates 43 are formed as extending toward a first insulation displacement portion 33 from outer sides 39*a* of the pair of insulation displacement blades 39 of a second insulation displacement portion 34. According to the above-mentioned arrangement, press-fitting projections cannot be disposed at a bottom plate 42. In this preferred embodiment, therefore, the pair of lateral plates 43 are provided at the upper end edges thereof (at the inlet sides of the slots 37, 41) with a pair of outwardly inclined retaining projections 25 arranged to bite into the inner walls of a contact holding portion 15.

Such an arrangement can also produce effects similar to those produced by the first above-mentioned preferred embodiment.

FIG. 9(*a*)~FIG. 9(*e*) are schematic side views illustrating another examples of the resilient nipping portion 44. The resilient nipping portion 44 in the preferred embodiment mentioned above is shown in FIG. 9(*a*). FIG. 9(*b*) shows an example in which both lateral sides 44*a*, 44*b* are made in a curved form concaved inwardly of the width direction of the plate-like body. FIG. 9(*c*) shows an example in which the lateral side 44*a* is linear and inclined with respect to the standing direction of the insulation displacement blades 39 such that the resilient nipping portion 44 is generally formed in a reverse trapezoid shape in side elevation. FIG. 9(*d*) shows an example in which both lateral sides 44*a*, 44*b* are linear and inclined with respect to the standing direction of the insulation displacement blades 39 such that the resilient nipping portion 44 is formed in a substantially equal-isosceles reverse-trapezoid shape inside elevation. FIG. 9(*e*) shows an example in which lateral sides 44*a*, 44*b* are made in a curved shape convexed outwardly of the width direction of the plate-like body. Also, it is surely acceptable to make either lateral side 44*a* or 44*b* in a convex curved shape.

The shape which can relax the most the stress concentration in the resilient nipping portion 44, is the shape shown in FIG. 9(*b*). In this case, however, the distance between the inner walls of the contact holding portion 15 of the housing 11 and the tip ends of the resilient nipping portions 44 is too long. This involves the likelihood that the contact 51 of the board-side connector 4 cannot securely be guided to the gap between the contact portions 46 by the contact receiving groove 48 (See FIG. 7(*a*)). This problem can be solved by the arrangement that the inner wall face of the contact holding portion 15 is made, as shown by a reference numeral 15A, in a convex curved shape along the lateral sides 44*b* of the resilient nipping portions 44. In the case of the resilient nipping portion 44 in FIG. 9(*a*), since the lateral side 44*b* is linear and extends along the standing direction of the insulation displacement blades 39, such a problem is not caused.

In comparison of the arrangements in FIG. 9(*c*) and FIG. 9(*d*) with each other, the arrangement in FIG. 9(*d*) is more effective in stress dispersion. When the arrangement in FIG. 9(*d*) is adopted, it is preferable that the inner wall face of the contact holding portion 15 is made, as shown by a reference numeral 15B, in an inclined shape along the lateral sides 44*b* of the resilient nipping portions 44, thus reducing the distance between the resilient nipping portions 44 and the inner wall face of the contact holding portion 15.

In the foregoing, various preferred embodiments of the present invention have been discussed, but the present invention may also be embodied in other manners. For example, in the above-mentioned preferred embodiments, the description has been made of the wire-side connectors of the 11-pole type. However, no particular restrictions are imposed on the number of poles in the wire-side connector. For example, a similar arrangement maybe adopted for a wire-side connector of the 2-pole or 20-pole type.

In the above-mentioned preferred embodiments, each resilient nipping portion 44 is gradually narrowed in width, in its entire range from the lateral plate 43 to the contact portion 46, in the direction toward the contact portion 46. However, stress dispersion can also be achieved when each resilient nipping portion 44 is gradually narrowed in width, in a portion of the range from the lateral plate 43 to the contact portion 46, in the direction toward the contact portion 46.

It is preferable to minimize the number of square portions in order to relax the stress concentration at the time of press work. Accordingly, the square portions of the tips of the resilient nipping portions 44 are preferably rounded to form the curved corners.

Preferred embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This Application corresponds to Japanese Patent Application No. 2004-111466 filed with the Japanese Patent Office on 5 Apr. 2004, the full disclosure of which is incorporated hereby by reference.

What is claimed is:

1. An insulation displacement contact comprising:

a pair of insulation displacement blades opposite to each other with their bases connected to each other, inner sides of the blades forming, a slot for receiving an insulated wire of which core wire portion is covered with an insulation, the pair of insulation displacement blades being arranged to cut the insulation and come in press-contact with the core wire portion when the insulated wire is inserted into the slot; and a pair of resilient contact pieces each made of a plate member which is connected to an outer side of each insulation displacement blade, which extends toward a side opposite an inlet of the slot up to a position exceeding the base of each insulation displacement blade, which has a contact portion for holding or nipping a mating contact at a position opposite the slot inlet with respect to the base of each insulation displacement blade, and which has, between the connection portion connected to the outer side of each insulation displacement blade and the contact portion, a tapering portion of which width is gradually narrowed in the direction toward the contact portion, wherein, when the insulated wire is inserted into the slot, respective ones of the pair of insulation displacement blades move apart from one another while simultaneously therewith respective ones of the pair of resilient contact pieces move toward each other.

2. An insulation displacement contact according to claim 1, wherein the insulation displacement contact is formed by punching or bending a single conductive metallic plate.

3. An insulation displacement contact according to claim 1, wherein each tapering portion is formed in an entire range from a contact-portion-side end of a connection portion connecting the resilient contact piece to the outer side of the insulation displacement blade, up to the contact portion.

4. An insulation displacement contact according to claim 1, wherein each tapering portion has a curved side concaved inwardly of the width of the plate member.

5. An insulation displacement contact according to claim 1, wherein two pairs of the insulation displacement blades are disposed as facing each other with the slots thereof aligned in a predetermined direction, and the two pairs of the insulation displacement blades are connected at their bases to each other by a connecting plate.

6. An insulation displacement contact according to claim 5, wherein the resilient contact pieces are connected to the outer sides of one pair of the two pairs of the insulation displacement blades, and are formed as extending in a direction opposite away from the other pair of the insulation displacement blades.

7. An insulation displacement contact according to claim 6, wherein the two pairs of the insulation displacement blades are respectively connected to both ends of the connecting plate, and the connecting plate is provided at lateral sides thereof with retaining projections arranged to be engaged with inner walls of a housing of an electric connector.

8. An insulation displacement contact according to claim 5, wherein the resilient contact pieces are connected to the outer sides of one pair of the two pairs of the insulation displacement blades, and are formed as extending in a direction toward the other pair of the insulation displacement blades.

9. An insulation displacement contact according to claim 8, wherein retaining projections to be engaged with inner walls of a housing of an electric connector are disposed at end edges of the resilient contact pieces which are opposite of the contact portions thereof.

10. An electric connector comprising:

an insulation displacement contact; and a housing made of resin which holds the insulation displacement contact in a contact holding portion, the insulation displacement contact including:

a pair of insulation displacement blades opposite to each other with their bases connected to each other, inner sides of the blades forming, a slot for receiving an insulated wire of which core wire portion is covered with an insulation, the pair of insulation displacement blades being arranged to cut the insulation and come in press-contact with the core wire portion when the insulated wire is inserted into the slot; and a pair of resilient contact pieces each made of a plate member which is connected to an outer side of each insulation displacement blade, which extends toward a side opposite an inlet of the slot up to a position exceeding the base of each insulation displacement blade, which has a contact portion for holding or nipping a mating contact at a position opposite the slot inlet with respect to the base of each insulation displacement blade, and which has, between the connection portion connected to the outer side of each insulation displacement blade and the contact portion, a tapering portionof which width is gradually narrowed in the direction toward the contact portion, wherein, when the insulated wire is inserted into the slot, respective ones of the pair of insulation displacement blades move apart from one another while simultaneously therewith respective ones of the pair of resilient contact pieces move toward each other.

* * * * *